US009570810B2

(12) United States Patent
Kerselaers et al.

(10) Patent No.: US 9,570,810 B2
(45) Date of Patent: Feb. 14, 2017

(54) VEHICLE ANTENNA

(71) Applicant: NXP B.V., Eindhoven (NL)

(72) Inventors: Anthony Kerselaers, Herselt (BE); Liesbeth Gomme, Anderlecht (BE)

(73) Assignee: NXP B.V., Eindhoven (NL)

( * ) Notice: Subject to any disclaimer, the term of this patent is extended or adjusted under 35 U.S.C. 154(b) by 120 days.

(21) Appl. No.: 14/266,470

(22) Filed: Apr. 30, 2014

(65) Prior Publication Data

US 2014/0347231 A1 Nov. 27, 2014

(30) Foreign Application Priority Data

May 23, 2013 (EP) ..... 13168948

(51) Int. Cl.

| | |
|---|---|
| ***H01Q 1/32*** | (2006.01) |
| ***H01Q 13/10*** | (2006.01) |
| ***H01Q 1/38*** | (2006.01) |
| ***H01Q 9/32*** | (2006.01) |
| ***H01Q 25/00*** | (2006.01) |

(52) U.S. Cl.

CPC ..... *H01Q 13/106* (2013.01); *H01Q 1/3275* (2013.01); *H01Q 1/38* (2013.01); *H01Q 9/32* (2013.01); *H01Q 25/00* (2013.01)

(58) Field of Classification Search

CPC ..... H01Q 9/32; H01Q 1/38; H01Q 13/106; H01Q 1/3275; H01Q 25/00

USPC ..... 343/846, 700 MS, 702, 713, 767, 770

See application file for complete search history.

(56) References Cited

U.S. PATENT DOCUMENTS

| | | | | |
|---|---|---|---|---|
| 5,734,350 | A * | 3/1998 | Deming | H01Q 1/42 343/700 MS |
| 6,160,515 | A * | 12/2000 | McCoy | H01Q 1/241 343/702 |
| 6,304,219 | B1 * | 10/2001 | Rothe | H01Q 1/24 343/700 MS |
| 6,342,868 | B1 | 1/2002 | Tsai et al. | |
| 7,119,745 | B2 * | 10/2006 | Gaucher | H01Q 9/26 343/700 MS |
| 7,129,902 | B2 * | 10/2006 | Bancroft | H01Q 13/10 343/700 MS |
| 8,405,555 | B2 * | 3/2013 | Liu | H01Q 9/40 343/700 MS |
| 2008/0106478 | A1 * | 5/2008 | Hill | H01Q 1/243 343/702 |

(Continued)

FOREIGN PATENT DOCUMENTS

| | | |
|---|---|---|
| GB | 2 450 786 A | 1/2009 |
| WO | 2006/061218 A1 | 6/2006 |
| WO | 2008/131157 A1 | 10/2008 |

OTHER PUBLICATIONS

Boyes, S. J., et al; "Comparison of Diversity Gain Performance of Single Element Dual-Feed PIFAs with Assorted MIMO Antennas"; IEEE International Workshop on Digital Object Identifier; pp. 214-217 (2011).

(Continued)

*Primary Examiner* — Dameon E Levi
*Assistant Examiner* — Ab Salam Alkassim, Jr.

(57) ABSTRACT

The invention provides an antenna which has two feed ports and two conductor areas. Where the two areas face each other, there is a set of interdigitated arms and slots. These define a shape with two open slots (one on each side) extending from the two feed points, and a central closed slot.

18 Claims, 11 Drawing Sheets

(56) References Cited

U.S. PATENT DOCUMENTS

| | | | | |
|---|---|---|---|---|
| 2009/0102724 | A1* | 4/2009 | Tsutsumi | H01Q 1/2258 343/700 MS |
| 2009/0153411 | A1* | 6/2009 | Chiang | H01Q 1/243 343/702 |
| 2009/0262028 | A1* | 10/2009 | Mumbru | H01Q 1/243 343/702 |
| 2011/0133992 | A1* | 6/2011 | Suzuki | H01Q 1/38 343/700 MS |
| 2011/0140975 | A1* | 6/2011 | Shigetomi | H01Q 1/3291 343/713 |
| 2011/0309993 | A1* | 12/2011 | He | H01Q 1/38 343/860 |
| 2013/0176180 | A1* | 7/2013 | Wakui | H01Q 1/3275 343/702 |
| 2013/0210366 | A1* | 8/2013 | Hansen | H01Q 1/325 455/63.4 |
| 2013/0293425 | A1* | 11/2013 | Zhu | H01Q 1/243 343/702 |

OTHER PUBLICATIONS

Extended European Search report for application No. 13168948.1 (Sep. 27, 2013).

* cited by examiner

VEHICLE ANTENNA

CROSS-REFERENCE TO RELATED APPLICATIONS

This application claims the priority under 35 U.S.C. §119 of European patent application No. 13168948.1, filed on May 23,2013, the contents of which are incorporated by reference herein.

This invention relates to vehicle antennas.

The invention of particular interest for to car-to-car (C2C) and car-to-infrastructure (C2I) communication.

Car-to-car and car-to-infrastructure communications are believed to be a key technology in contributing to safe and intelligent mobility in the future. A car-to-car or car-to-infrastructure communication link is made up from various components of which the antenna is the subject of this invention.

Today's vehicles are equipped with many wireless services to receive radio and television broadcasting and for communication like cellular phone and GPS for navigation. Even more communication systems will be implemented for "intelligent driving" such as dedicated short range communication ("DSRC"). As a result, the number of automotive antennas is increasing and the miniaturization requirements are becoming an important factor to reduce the cost price.

In general, known diversity systems in cars make use of two or more different antenna elements that are positioned far from each other to increase isolation between them.

A diversity antenna can be found in the IEEE publication: Comparison of Diversity Gain Performance of Single Element Dual-Feed PIFAs with Assorted MIMO Antennas, S. J. Boyes, H. T. Chattha, and Y. Huang.

The car-to-car communication system in Europe and USA makes uses of the IEEE802.11P standard which operates in the 5 GHz frequency band.

ITS-G5A and ITS-G5B: 5.855-5.925GHz

ITS-GSC: 5.470-5.725GHz (WLAN)

The invention relates to an antenna, which in the preferred example can be provided within the shark fin arrangement.

FIG. 1 shows an example of a standard shark fin antenna unit that is positioned at the backside of the rooftop of a vehicle. The antennas embedded in the shark fin are restricted in dimensions and should be designed to fit in the housing. The antenna unit also has stringent requirements for weather protection, shock resistance and temperature rise.

Standard dimensions for the antenna unit are: Maximum height of 50 to 55 mm (external housing height of 60 mm), Length of 120 mm (external housing length of 140 mm), Width of 40 mm (external housing width of 50 mm).

The maximum achievable height of around 50 mm has some implications on attainable frequency since there is a dependency of frequency and antenna size. A single resonant antenna element has dimensions which are proportional to the wavelength of operation and inversely proportional to the frequency of operation. Hence, low operating frequencies require large antenna structures. A resonant quarter wave monopole antenna ($L=\lambda/4$) is a classical antenna that is used above a rooftop of a vehicle or above a ground plane.

The inner dimensions have implications on the number of antennas that can be integrated. It is not always feasible to integrate multiple antenna elements for the same frequency band with sufficient distance between them.

The invention is defined by the claims.

According to the invention, there is provided an antenna comprising:

a planar substrate;

a conductor pattern printed on one side of the substrate wherein the conductor pattern comprises first and second separate continuous conductor areas, wherein the first conductor area is generally at one end of the substrate and the second conductor area is generally at the other end of the substrate, wherein a first direction extends between the ends;

wherein the first conductor area has two arms, one on each outer side, and the two first conductor area arms extend parallel to the first direction, and define a first slot between them, wherein the second conductor area has two arms with a second slot defined between them, and the two second conductor area arms extend parallel to the first direction, wherein the two second conductor area arms sit within the first slot with a portion of the first slot at the outer sides of the two second conductor area arms;

a first antenna feed which bridges the end of one of the two second conductor area arms and the base of the first slot; and a second antenna feed which bridges the end of the other of the two second conductor area arms and the base of the first slot.

This arrangement combines two antenna feed into a single structure. The conductor areas face each other, and where they meet, parallel arms of one pass into a slot defined in the other, thereby defining an interleaved arrangement of arms and slots. In this way, two open slots are defined towards the outer edges and one closed slot is defined in the middle.

The closed slot provides isolation between the feeds

The invention provides an antenna suitable for Intelligent Transportation Systems (ITS) that enables successful car-to-car and car-to-infrastructure communication. A diversity or MIMO (Multiple Input Multiple Output) functionality is provided in a single antenna element that can for example fit in an aftermarket shark fin together with other components such as a COTS GPS module and/or cellular antennas.

The antenna provides the replacement of two physically separated antennas by a single antenna in one physical position. The antenna can be placed in other positions with restricted space, such as in the side mirrors.

The antenna is of particular interest for diversity or MIMO functionality for car-to-car communication, ITS-G5A and ITS-G5B (5.855-5.925 GHz) and ITS-G5C (5.470-5.725 GHz).

The antenna can be mounted in a compact area like for example in a mirror or shark fin where The compact and highly integrated diversity antenna consists of a single antenna structure (with two conductor areas) with two feeding ports that are sufficiently matched and isolated. The antenna can be implemented with and without a ground plane and for example provides 10 dB diversity gain.

The antenna preferably has a bottom edge and a top edge, which comprise the one end and the other end. The antenna can then be grounded at one end to a horizontal conducting plane.

The feeds can be for a frequency band within the range 4.95-6.0 GHz, for example it can be designed for an operational frequency of 5.9 GHz.

Each arm preferably has a length in the range 4 mm to 7 mm, for an operational frequency of 5.9 GHz. This means that slots of corresponding length are formed, and this corresponding length represents a quarter electrical wavelength at the operational frequency.

The first conductor area can comprise a rectangular part at the one end of the substrate from one edge of which the two first conductor area arms extend. The first conductor area can have an overall length of the rectangular part and the first conductor area arms, in the first direction, of 14 to 18 mm. This corresponds to a half electrical wavelength at the operational frequency.

The substrate preferably has a generally rectangular shape with width less than 15 mm and length less than 30 mm.

An example of the invention will now be described in detail with reference to the accompanying drawings, in which.

The invention provides an antenna which has two feed ports and two conductor areas. Where the two areas face each other, there is a set of interdigitated arms and slots. These define a shape with two open slots (one on each side) extending from the two feed points, and a central closed slot.

Figure 1:
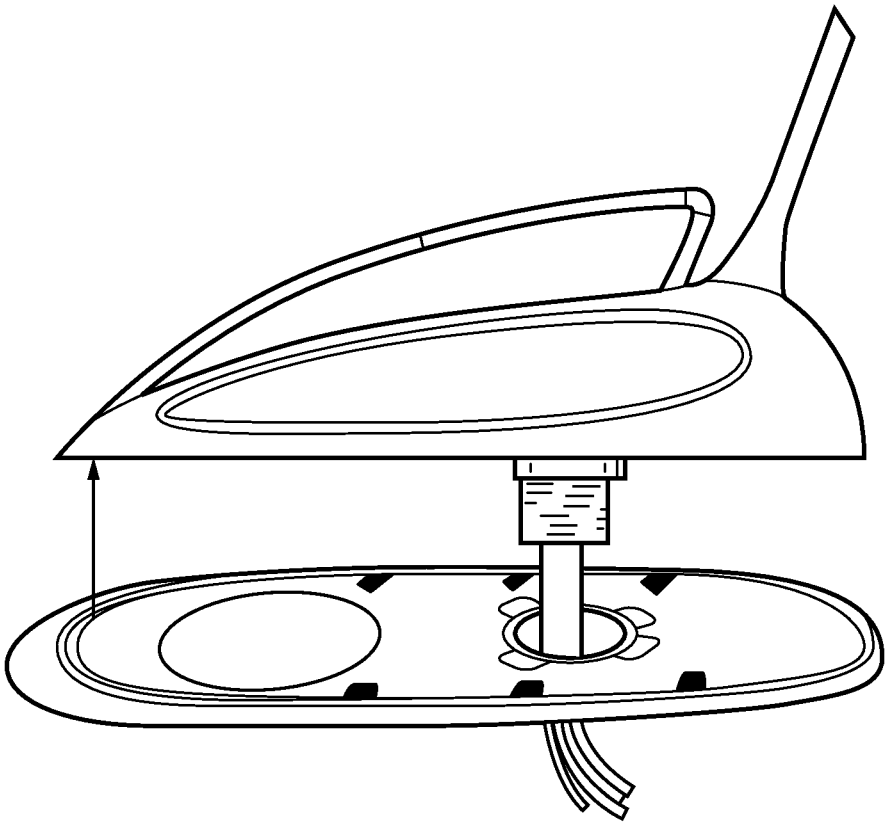
FIG. 1 shows a known shark fin antenna unit.
Figure 2:
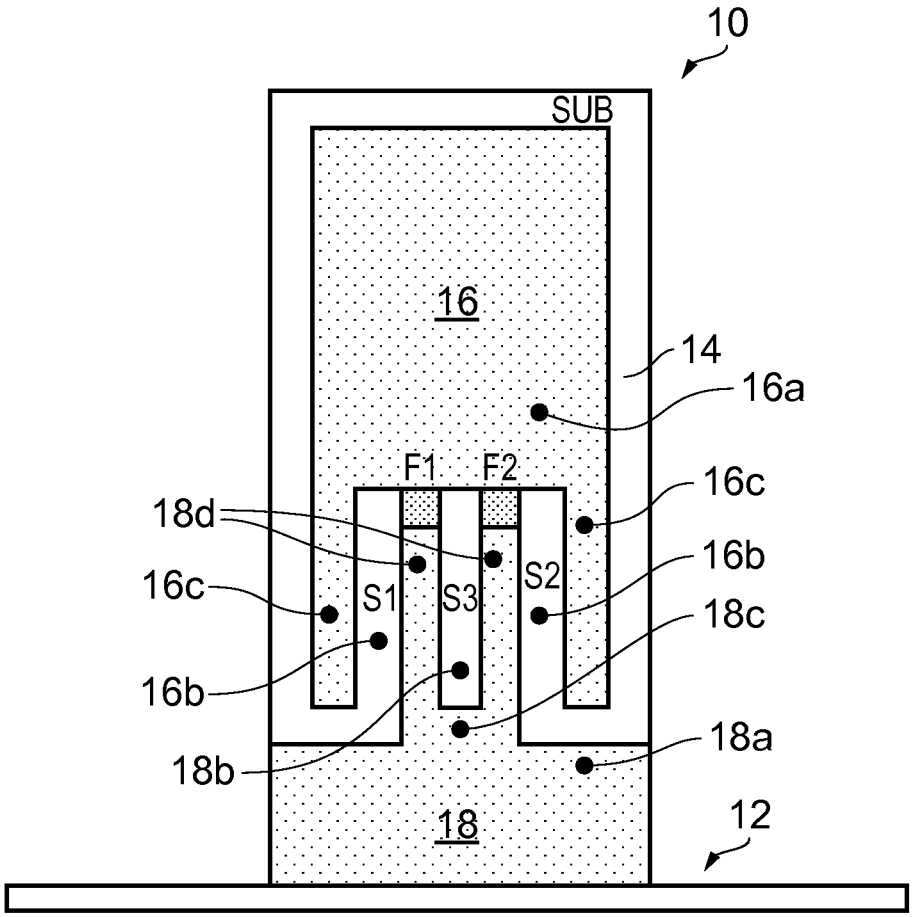
FIG. 2 shows an example of diversity antenna of the invention.

FIG. 2 shows the diversity antenna 10. The antenna consists of a conducting surface that is connected in one example to a ground plane 12. The conducting surface can be planar. The antenna element can operate above a ground plane, like a roof top of a car or can also operate without a ground plane.

The conducting surface is attached to a planar substrate 14. The substrate can be a printed circuit board material such as FR4 or any dielectric material that has sufficient performance for the frequency bands of operation.

The choice of substrate can be kept low cost and the fabrication can be kept very low cost since existing technologies for printed circuit boards can be used.

The conducting surface can be copper or another material that has sufficient performance for the frequency bands of operation. The conducting surface can be very thin, for example 35 μm. The conducting surface can be covered by a protecting layer to prevent oxidation and to reduce degradation due to temperature and as such to fulfill the stringent automotive requirements.

The antenna 10 has a conducting surface on one side of the substrate making it a low cost concept in terms of manufacturing.

The conducting surface is connected to the ground plane 12 at the bottom by a holder fixing the antenna element. In this way the conductive surface can be considered as an extension of the ground plane.

The conducting surface contains two sub-surfaces 16 and 18. Each of these sub-surfaces comprises a main rectangular body 16*a*, 18*a* body and a slot arrangement 16*b*, 18*b*. A slot is defined as a non conductive area inside a conductive surface.

The first sub-surface 16 has a single slot 16*b* set back into one face. The second sub-surface 18 has a projection 18*c* which extends into the single slot 16*b*. This projection 18*c* has a single slot 18*b* set back into the end face.

The interface between the two sub-surfaces 16,18 thus comprises two outer limbs 16*c* of the first sub-surface 16. Between these limbs are two inner limbs 18*d* of the second sub-surface 18. Between these inner limbs 18*d* is a central slot. This forms an interdigitated parallel arm (or finger) arrangement, with two outer arms of the first sub-surface 16 and two inner arms of the second sub-surface 18. The arms can have the same length.

Two feeding ports, F1 and F2, are connected between the two sub-surfaces, between the inner edge of the single slot 16*b* of the first sub-surface and the ends of the two inner arms 18*d* of the second sub-surface 18. Considered from the position of the feeding points F1 and F2, the first sub-surface 16 contains an open slot S1 and an open slot S2. These are essentially the opposite lateral parts of the slot 16*b*. Considered from the position of the feeding points F1 and F2 the second sub-surface SS2 contains a closed slot S3.

"Open" means that there is not conductive material at the end of the slot, and "closed" means that there is conductive material at the end of the slot.

The length of the first sub-surface 16 (including the main area and the arms) represents the half electrical wavelength of the operational frequency while the length of the open slots S1 and S2 is a quarter electrical wavelength of the operational frequency.

The width of the first sub-surface 16 is not directly related to the wavelength and can be smaller than quarter of the wavelength. The width of the first sub-surface 16 does have an influence on the operational bandwidth of the antenna, a larger width results in a larger bandwidth.

The length of the closed slot 18*b* (S3) in the second sub-surface 18 defines the frequency where the two feeding ports, F1 and F2, have largest isolation. The length of closed slot S3 is a quarter electrical wavelength of the frequency where the maximum isolation is found. This is because a quarter wavelength slot that is closed at the end presents a high input impedance at the input.

The feeding ports F1 and F2 connected between the two sub-surfaces 16,18 generate a current around the slots S1 and S2. This current couples into first sub-surface 16, and more precisely spreads out across the length, that is half the resonant wavelength at the frequency of operation.

The width of slots S1 and S2 can be used to influence the input impedance of the feeding ports. This mechanism allows matching of both feeding ports.

Figure 3:
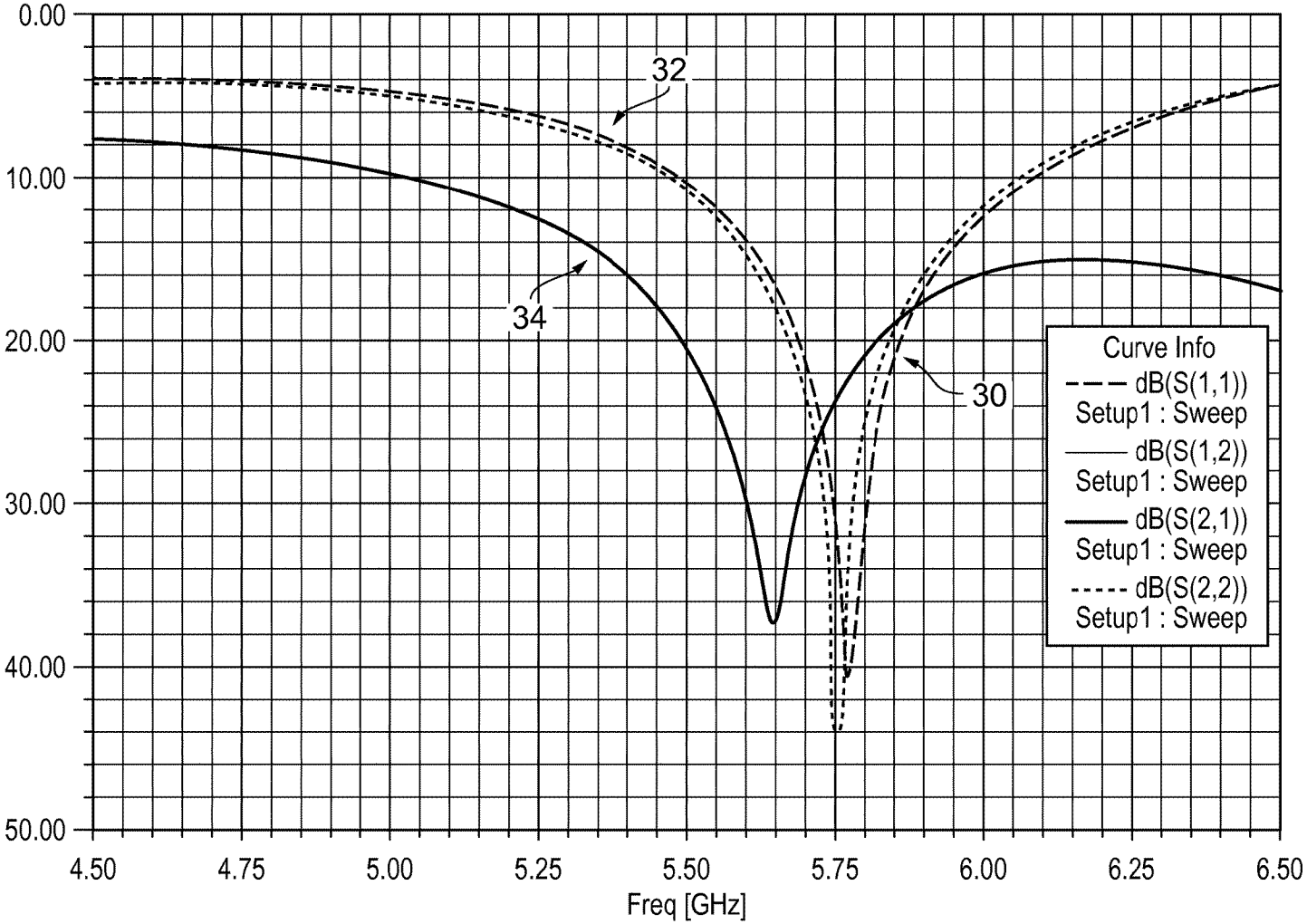
FIG. 3 shows the simulated reflection coefficients of both feeding ports [db] of the antenna of FIG. 2.

FIG. 3 shows the simulated reflection coefficients and isolation of both feeding ports (in dB) of the antenna of FIG. 2.

Plot 30 shows the input reflection coefficient of feeding port F1 (|S11|).

Plot 32 shows the input reflection coefficient of feeding port F2 (|S22|). Plot 34 shows the isolation between the two ports (both |S21| and |S21| are represented by the same plot).

There is a good matching of both feeding ports F1 and F2 and sufficient isolation in the frequency range 5.470-5.925 GHz.

|S11| and |S22| are below −9.5 db and |S21| or |S21| are below −10 db.

Figure 4:
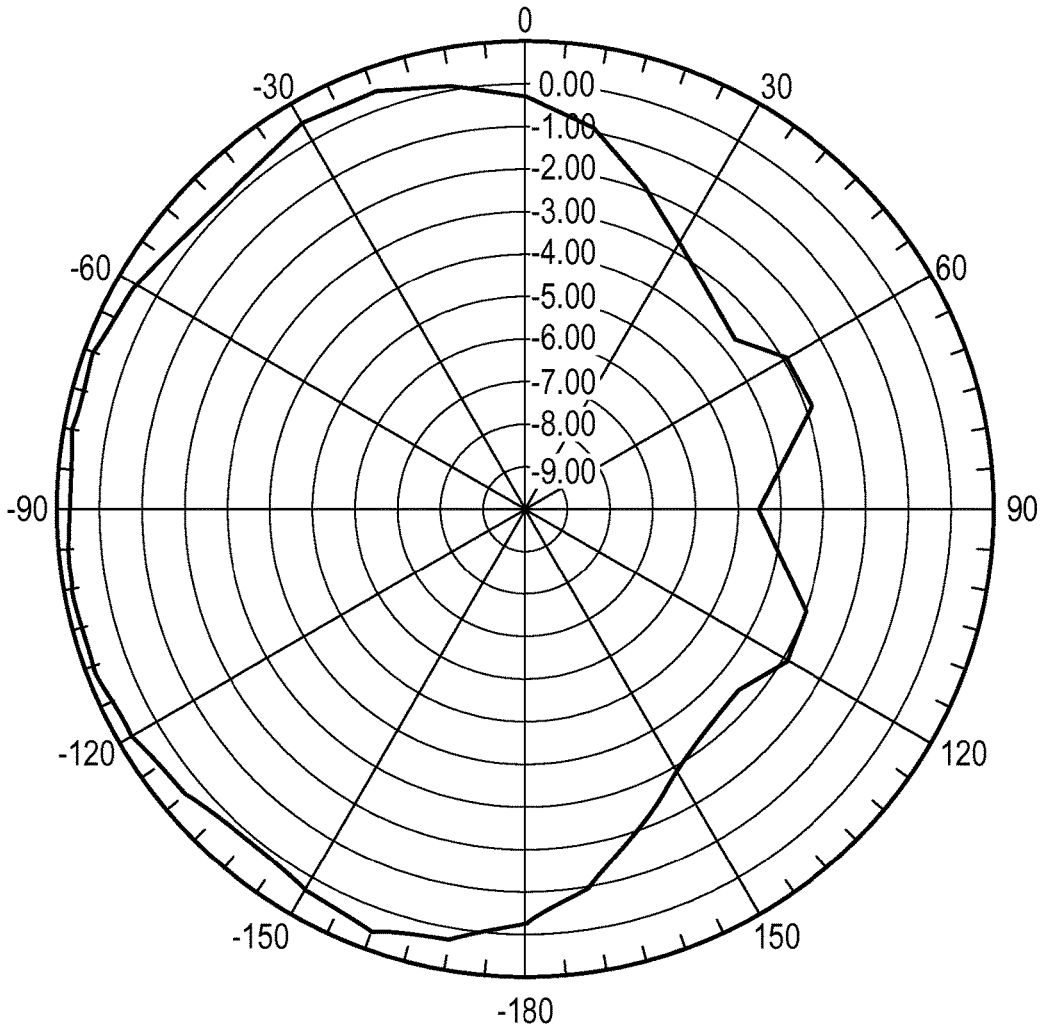
FIG. 4 shows the simulated radiation pattern [dBi] of the antenna of FIG. 2 in the horizontal plane at 6 GHz, with feeding port F1 powered.
Figure 5:
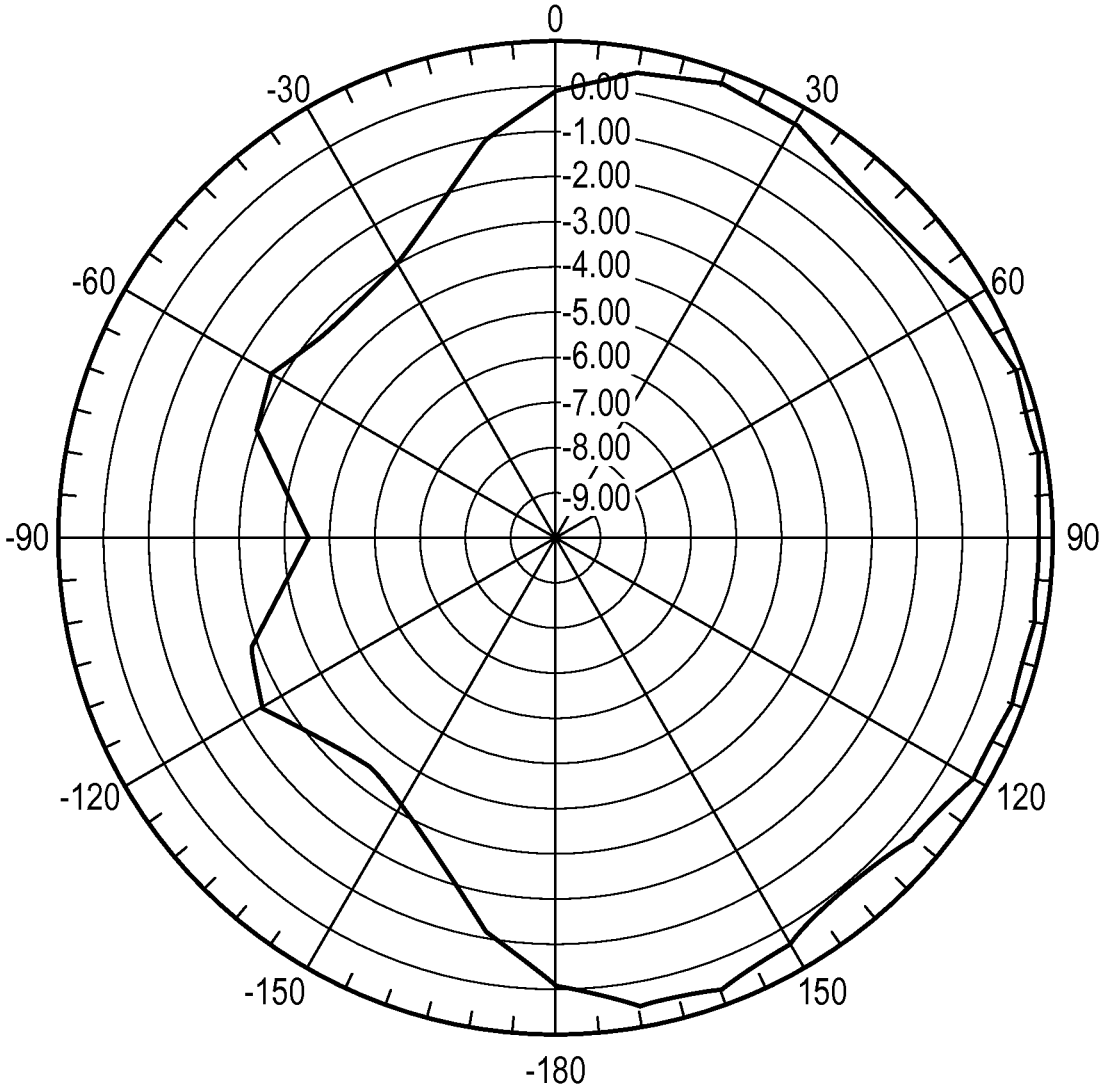
FIG. 5 shows the simulated radiation pattern [dBi] of the antenna of FIG. 2 in the horizontal plane at 6 GHz, with feeding port F2 powered.
Figure 6:
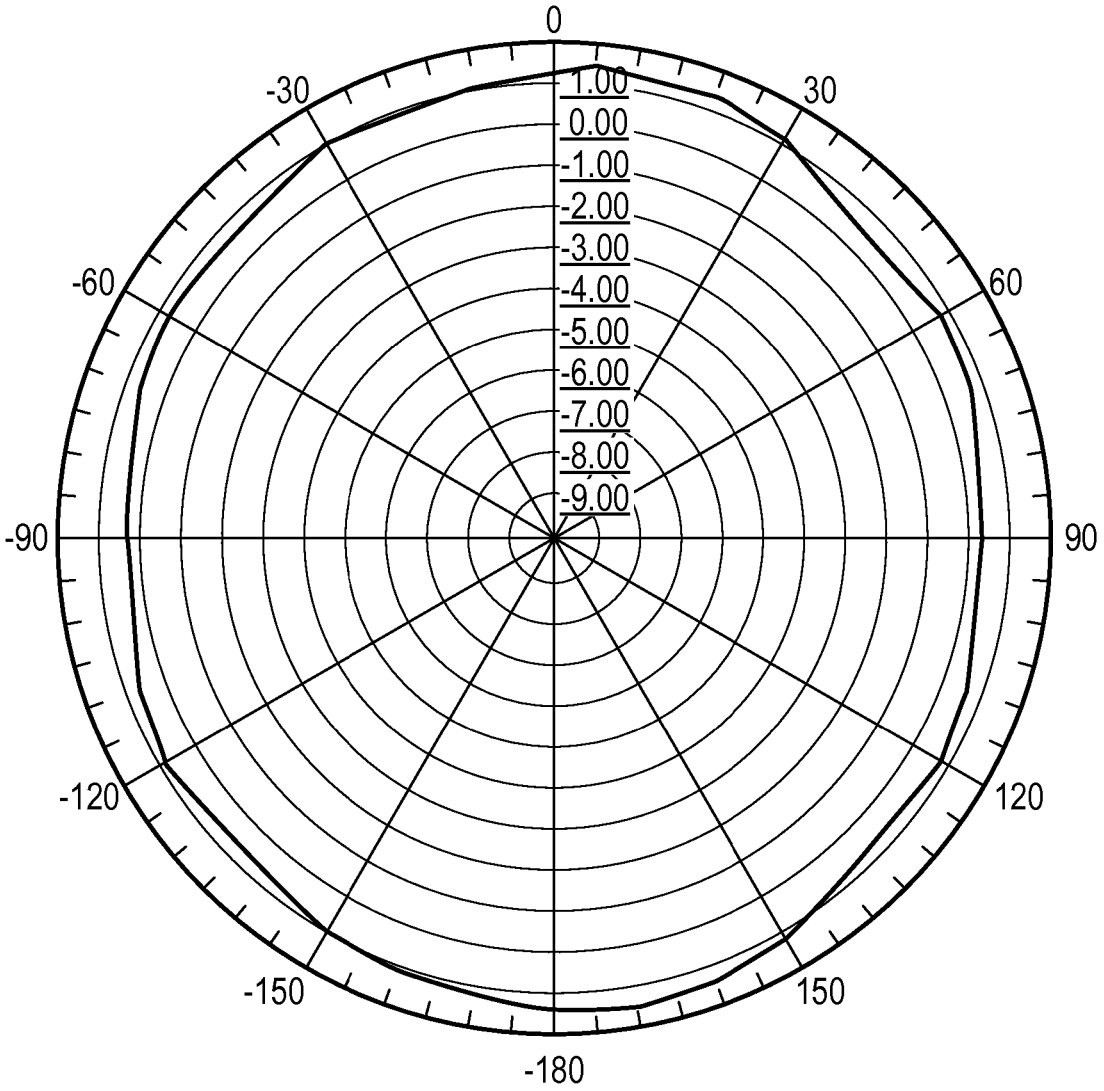
FIG. 6 shows the simulated radiation pattern [dBi] of the antenna of FIG. 2 in the horizontal plane at 6 GHz, with feeding ports F1 and F2 powered.

FIGS. 4 to 6 show simulated radiation patterns (in dBi) of the antenna of FIG. 2 in the horizontal plane at 6 GHz.

In FIG. 4, the feeding port F1 is powered, in FIG. 5 the feeding port F2 is powered and in FIG. 6 both feeding ports are powered.

The directivity of the radiation depends on which port is fed. For transmit diversity, both ports are fed with the same RF signal and an omni-directional radiation pattern is established.

Figure 7:
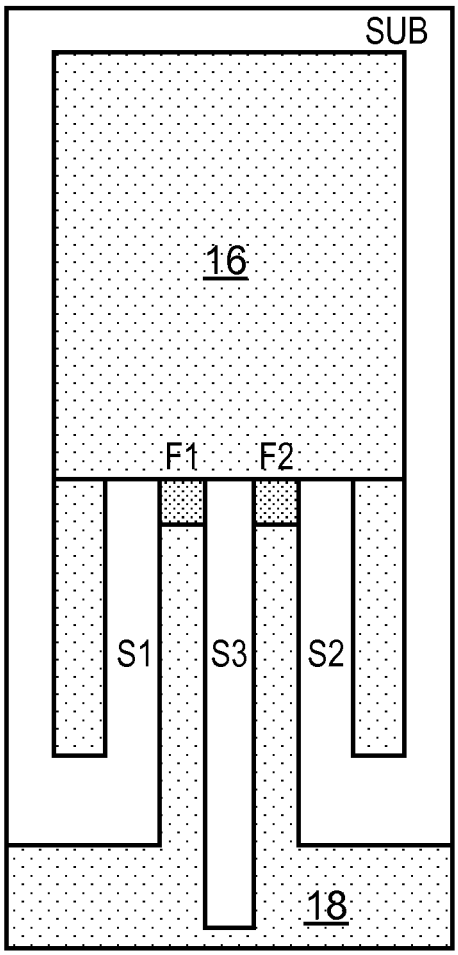
FIG. 7 shows the antenna of FIG. 2 working without a ground plane.

FIG. 7 shows the antenna structure without a ground plane. The same electrical parameters are found when analyzing this example.

In this case, the closed slot is longer, because in the grounded situation, the slot is electrically enlarged by loading by the ground plane.

Figure 8:
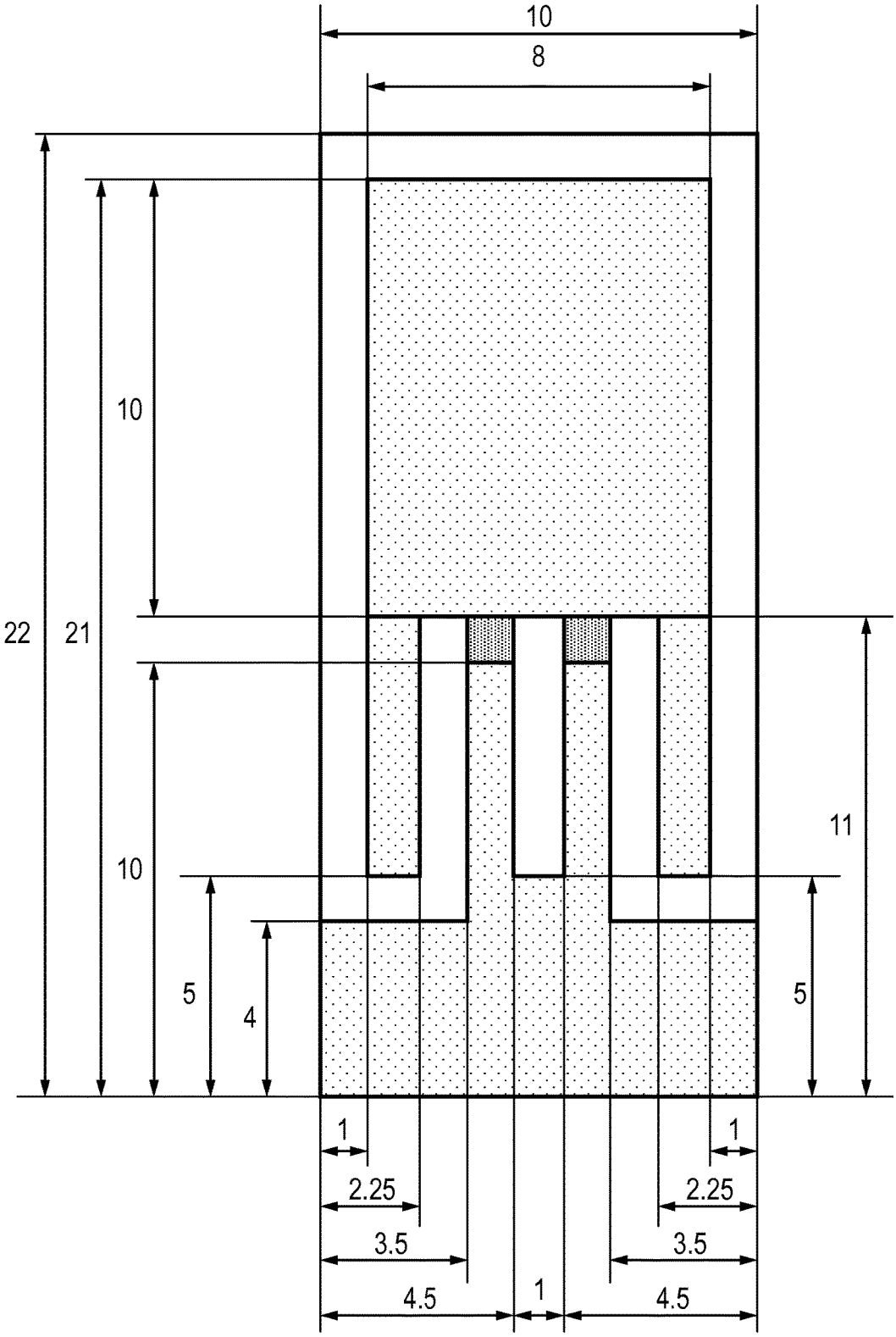
FIG. 8 shows dimensions [in mm] of an example the antenna of FIG. 2.

FIG. 8 shows the dimensions (in mm) of an example model of the antenna of FIG. 2 that is suitable for operation in the frequency band 5.470-5.925 GHz. This example has also been built and validated.

The important parameters are:

the first sub-section main area 16 has a length of 16 mm which represents an electrical half wavelength of 5.9 GHz (taking into account the reduction of the electromagnetic wave speed by the dielectric).

the total length of slot S1 and slot S2 (including the vertical main length and the horizontal elbow) is approximately 8 mm which represents an electrical quarter wavelength.

the closed slot lengths S2 is 6 mm, which presents an electrical quarter wavelength taking into account the effect of the ground plane.

As can be seen, the overall profile is 22 mm by 10 mm.

Figure 9:
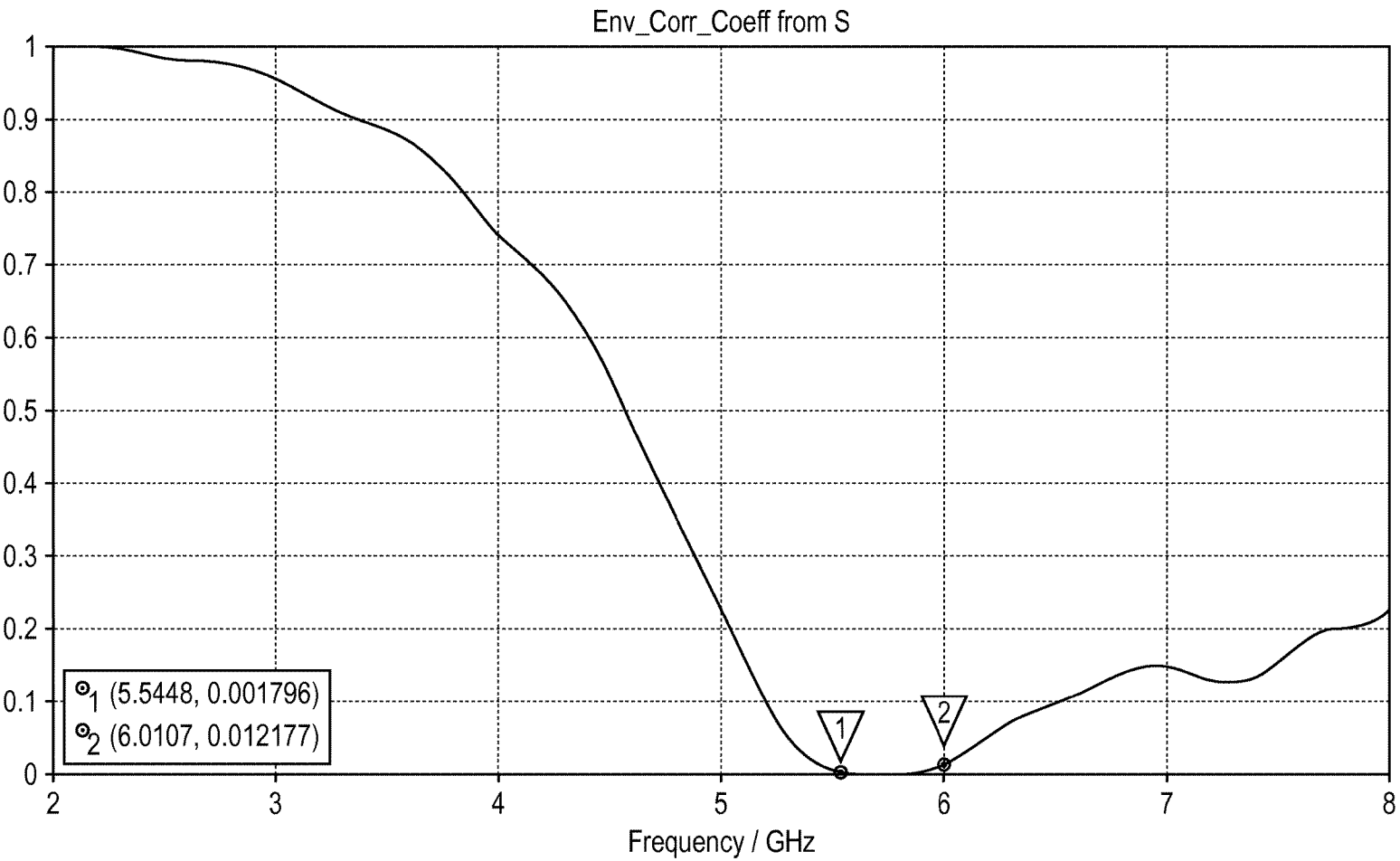
FIG. 9 shows the simulated envelope correlation coefficient of the diversity antenna of FIG. 2.
Figure 10:
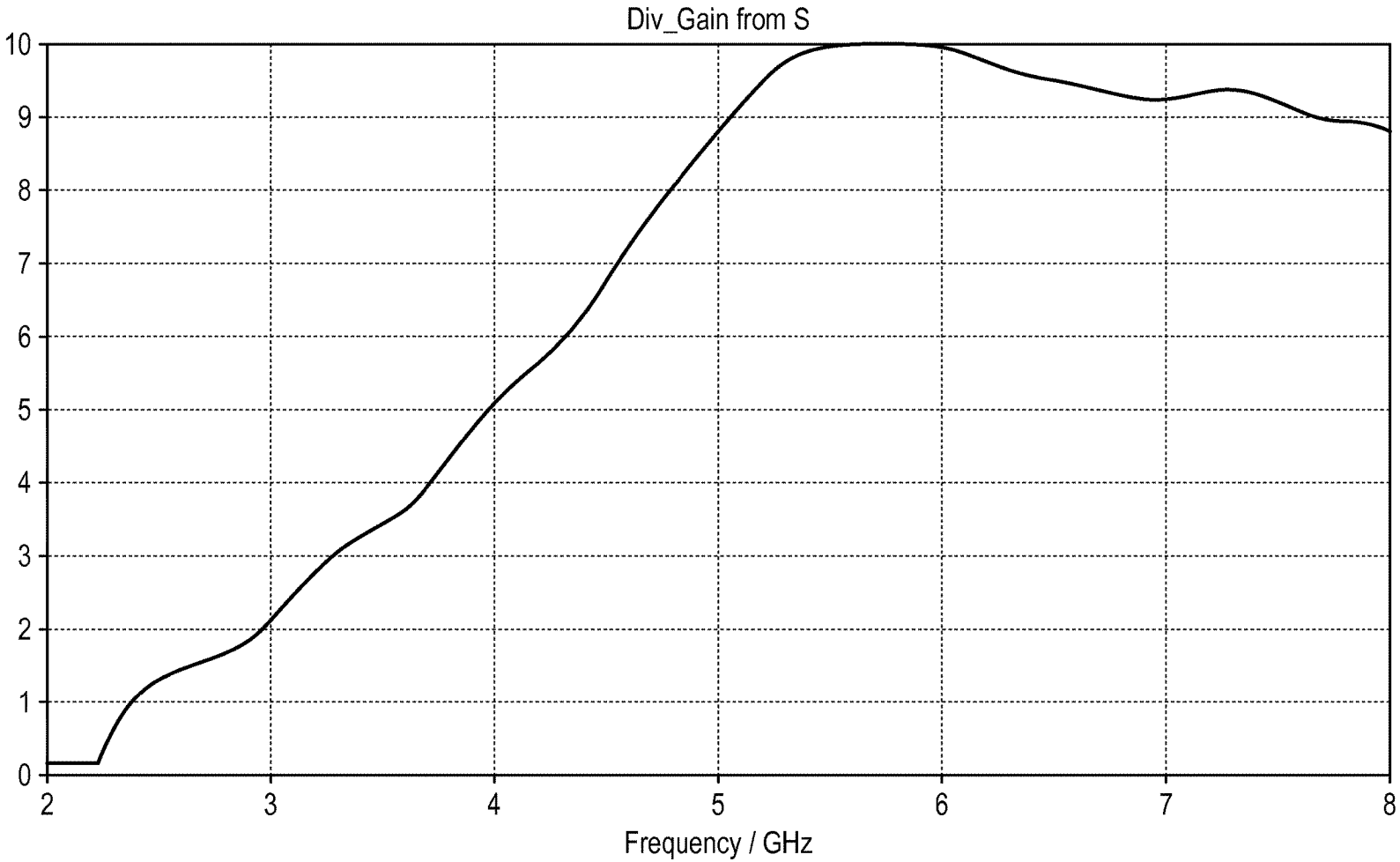
FIG. 10 shows the simulated diversity gain [dB] of the diversity antenna of FIG. 2.

FIG. 9 shows the simulated envelope correlation coefficient of diversity antenna of FIG. 2.

For multi-antenna systems for diversity and MIMO applications, the correlation between signals received by the involved antennas at the same node of a wireless communication link is an important figure of merit of the whole system.

The overall performance depends on the propagation behavior and antenna parameters. Usually, the envelope correlation coefficient is presented to evaluate the diversity capabilities of a multi-antenna system. This parameter should be preferably computed from 3D radiation patterns but this method is actually laborious and may suffer from errors if insufficient pattern cuts are taken into account in the computation.

Assuming that the antennas will operate in a uniform multi-path environment, an alternative method consists in computing this parameter from its scattering parameter definition. The envelope correlation of two antennas is given by:

$$\rho_{12} = \frac{|S_{11}^* S_{12} + S_{12}^* S_{22}|^2}{(1 - |S_{11}|^2 - |S_{21}|^2)(1 - |S_{22}|^2 - |S_{12}|^2)}$$

When the envelope correlation coefficient is smaller than 0.5, sufficient diversity gain can be established.

As can be seen from FIG. 9, very low values of the envelope correlation coefficient are calculated in the frequency band of operation.

The effectiveness of diversity is usually presented in terms of diversity gain. Diversity gain can be defined as the improvement in time-averaged signal-to-noise ratio (SNR) from combined signals from a diversity antenna system, relative to the SNR from one single antenna in the system, preferably the best one. This definition is conditioned by the probability that the SNR is above a reference level. The probability value is optional but usually set to 50% or 99% reliability.

Figure displays the simulated diversity gain of proposed diversity antenna of FIG. 2 of 10 dB. These results show that the antenna is very well suited for diversity or MIMO operation.

Figure 11:
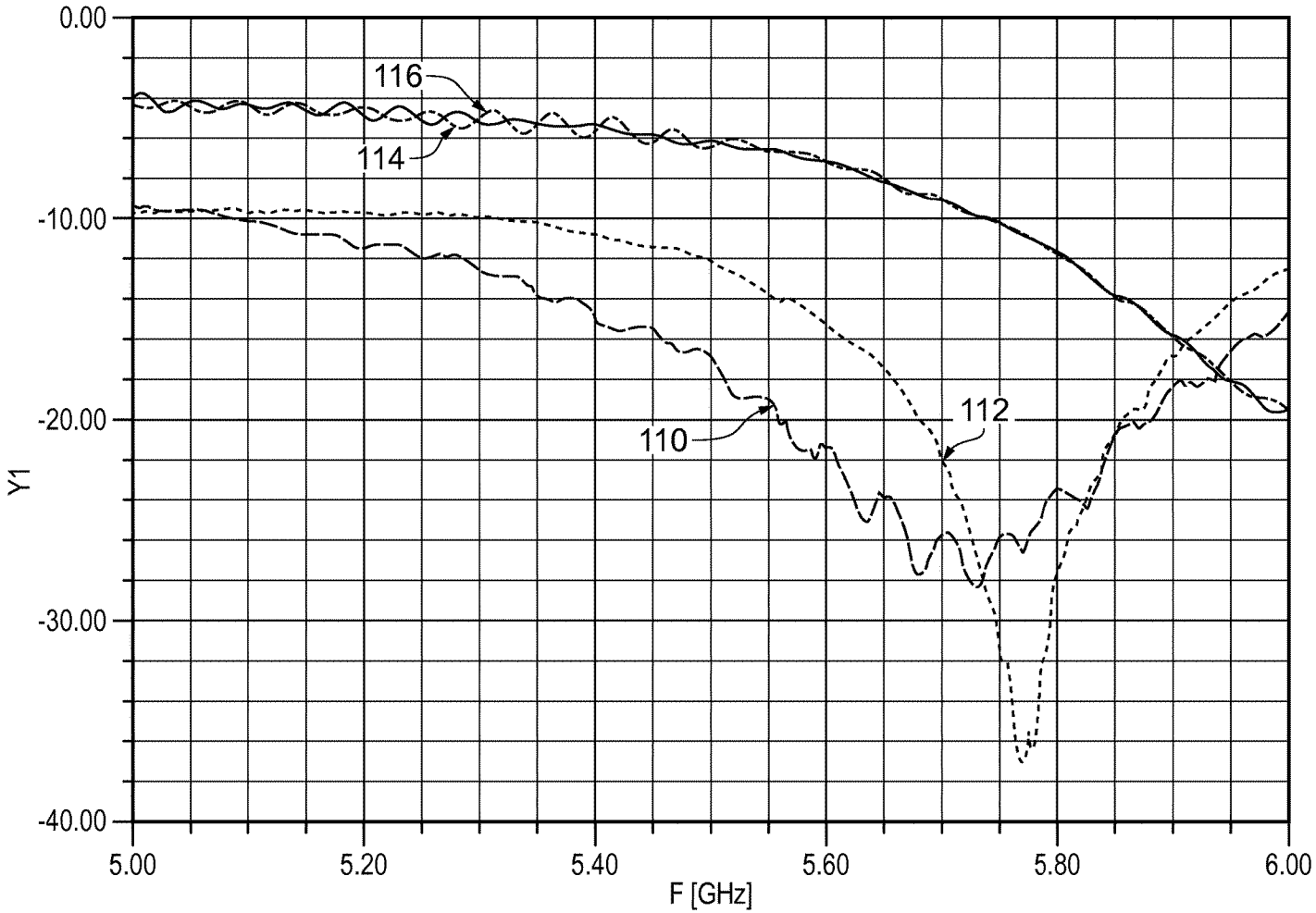
FIG. 11 shows the measured reflection coefficients at feeding port F1 and F2 [dB] and isolation between feeding ports F1 and F2 [dB] on a practical model according FIG. 2.

FIG. 11 displays the reflection coefficients measured at feeding port F1 and F2 (dB) on a practical model constructed according FIG. 2.

Plot 110: |S11|<−14.6 in band 5.4-6 GHz.

Plot 112: |S22|<−10.5 in band 5.4-6 GHz.

Plots 114,116: |S21| and |S12|<−6 db at 5.4 GHz and −19 db at 6 GHz.

It can be seen that sufficient performance can be obtained. There is difference in performance between |S11| and |S22| due to the construction tolerances. Further improvement is possible with additional tuning.

The Return Loss (S11) of the antenna meets the specification of minimum 9.5 dB (VSWR 2) at the frequencies of interest and the Isolation (S21) between the integrated structures is more than 10 dB at the frequencies of interest.

To use diversity during reception, signals are received at the two feeds independently, and combined during processing. The processing can be for example a proprietary algorithm or phase diversity which is mainstream in broadcast systems.

Other use cases are possible in car-to-car communication. In receive mode different channels can be received at the same time by each feed, for example a safety channel and a broadcast channel.

In transmit mode, both antennas can be driven by the same transmitter output signal to modify the covering range and increase radiated power. Another use case is when transmit diversity is used to generate multipath signals like in a MIMO application. The frequency of both signals is the same but there is a time difference between both signals. In this way the received signal strength can be increased. In another use case two different signals can be transmitted the same time and so increasing the data throughput.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An antenna comprising:

a planar substrate;

a conductor pattern printed on one side of the planar substrate, wherein the conductor pattern comprises first and second separate continuous conductor areas, the first conductor area is generally at one end of the planar substrate and the second conductor area generally at an opposite end of the planar substrate, a first direction extends between the end, the first conductor area has two arms, one on each outer side, and the two first conductor area arms extend parallel to the first direction, and define a first slot between them, the second conductor area has two arms with a second slot defined between them, the two second conductor area arms extend parallel to the first direction, and the two second conductor area arms sit within the first slot with a portion of the first slot at the outer sides of the two second conductor area arms;

a first antenna feed which bridges an end of a first of the two second conductor area arms and a base of the first slot; and a second antenna feed which bridges an end of a second of the two second conductor area arms and the base of the first slot.

2. The antenna as claimed in claim 1, which in use is configured for vertical mounting, and has a bottom edge and a top edge, which comprise the first end and the second end.

3. The antenna as claimed in claim 2, configured to be grounded at the first end to a horizontal conducting plane.

4. The antenna as claimed in claim 1, configured to operate in a frequency band within the range 4.95-6.0 GHz.

5. The antenna as claimed in claim 4, configured to operate at an operational frequency of 5.9 GHz.

6. The antenna as claimed in claim 1, wherein each arm has a length in a range of 4 mm to 7 mm.

7. The antenna as claimed in claim 1, wherein the first conductor area comprises a rectangular part at the one end of the planar substrate from one edge of which the two first conductor area arms extend.

8. The antenna as claimed in claim 1, wherein the first conductor area has an overall length of the rectangular part and the first conductor area arms, in the first direction, of 14 to 18 mm.

9. The antenna as claimed in claim 1, wherein the second conductor area comprises a rectangular part at the opposite end of the planar substrate from one edge of which the two second conductor area arms extend.

10. The antenna as claimed in claim 1, wherein the planar substrate has a generally rectangular shape with a width less than 15 mm and a length less than 30 mm.

11. The antenna as claimed in claim 1, comprising a vehicle antenna.

12. A vehicle communications system, comprising the antenna as claimed in claim 11.

13. The antenna of claim 1, wherein the second slot is a central closed slot.

14. The antenna of claim 1, wherein the first slot is divided by the first antenna feed and the second antenna feed into two open slots.

15. The antenna of claim 1, wherein the first conductor area arms and the second conductor area arms have identical lengths.

16. The antenna of claim 1, wherein a length of the first conductor area corresponds to a half electrical wavelength of an operational frequency.

17. The antenna of claim 14, wherein lengths of the two open slots correspond to a quarter electrical wavelength of an operational frequency.

18. The antenna of claim 13, wherein a length of the central closed slot corresponds to a frequency of largest isolation.

* * * * *